US006313080B1

(12) United States Patent
Boskamp et al.

(10) Patent No.: US 6,313,080 B1
(45) **Date of Patent: *Nov. 6, 2001**

(54) DETERGENT COMPOSITIONS

(75) Inventors: Jelles Vincent Boskamp; Atze Jan van der Goot; Ronaldus Wilhelmus Westerhout, all of Vlaardingen (NL)

(73) Assignee: Unilever Home & Personal Care, USA division of Conopco, Inc., Greenwich, CT (US)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/244,003

(22) Filed: Feb. 4, 1999

(30) Foreign Application Priority Data

Feb. 4, 1998 (GB) ..... 9802390

(51) Int. Cl.[7] ..... C11D 17/00; C11D 1/62; C11D 3/12; C11D 3/386

(52) U.S. Cl. ..... 510/298; 510/320; 510/327; 510/330; 510/332; 510/334; 510/400; 510/446; 510/499; 510/504; 510/507

(58) Field of Search ..... 510/298, 320, 510/327, 330, 332, 334, 400, 446, 499, 504, 507

(56) References Cited

U.S. PATENT DOCUMENTS

| | | | | |
|---|---|---|---|---|
| 3,154,494 | * | 10/1964 | Speak et al. | 510/298 |
| 3,407,144 | * | 10/1968 | Bath et al. | 510/298 |
| 3,953,350 | | 4/1976 | Fujino et al. | 252/94 |
| 3,962,107 | | 6/1976 | Levin et al. | 252/100 |
| 4,062,647 | | 12/1977 | Storms et al. | 8/137 |
| 4,134,838 | * | 1/1979 | Hooper et al. | 252/8.8 |
| 4,642,197 | | 2/1987 | Kruse et al. | 252/98 |
| 4,661,289 | * | 4/1987 | Parslow et al. | 510/322 |
| 4,898,680 | * | 2/1990 | Clauss et al. | 510/330 |
| 5,133,892 | * | 7/1992 | Chun et al. | 510/224 |
| 5,360,567 | * | 11/1994 | Fry et al. | 510/298 |
| 5,407,594 | * | 4/1995 | Fry et al. | 510/439 |
| 5,433,881 | * | 7/1995 | Townend et al. | 510/313 |
| 5,759,974 | * | 6/1998 | Menke et al. | 510/191 |
| 5,900,399 | * | 5/1999 | Seiter et al. | 510/446 |
| 5,972,870 | * | 10/1999 | Anderson | 510/298 |

FOREIGN PATENT DOCUMENTS

| | | | |
|---|---|---|---|
| 4404279 | | 8/1996 | (DE) . |
| 0151203 | * | 8/1985 | (EP) . |
| 466 484 | | 1/1992 | (EP) . |
| 481 793 | | 4/1992 | (EP) . |
| 522 766 | | 1/1993 | (EP) . |
| 711 827 | | 5/1996 | (EP) . |
| 711 828 | | 5/1996 | (EP) . |
| 716 144 | | 6/1996 | (EP) . |
| 799 886 | | 10/1997 | (EP) . |
| 838 519 | | 4/1998 | (EP) . |
| 1 035 199 | | 9/2000 | (EP) . |
| 911204 | | 11/1962 | (GB) . |
| 993583 | | 5/1965 | (GB) . |
| 1080066 | | 8/1967 | (GB) . |
| 1307387 | * | 2/1973 | (GB) . |

(List continued on next page.)

OTHER PUBLICATIONS

Derwent abstract of DE 4404279.

*Primary Examiner*—Lorna M. Douyon
(74) *Attorney, Agent, or Firm*—Rimma Mitelman

(57) ABSTRACT

A detergent tablet for fabric washing is compacted from particulate detergent composition(s) with a fabric conditioning agent present in one zone (20,26,36,40) of the tablet at a greater concentration than in another zone (22,24,28,30, 42). The conditioning agent may be a softening agent in a zone or region which disintegrates later than another zone or region of the tablet.

14 Claims, 1 Drawing Sheet

FOREIGN PATENT DOCUMENTS

| | | | |
|---|---|---|---|
| 1368599 | * | 10/1974 | (GB) . |
| 1 538 893 | | 1/1979 | (GB) . |
| 2075028 | * | 11/1981 | (GB) . |
| 60-15500 | | 1/1985 | (JP) . |
| 60-135497 | | 7/1985 | (JP) . |
| 89/04863 | | 6/1989 | (WO) . |
| 395 333 | | 10/1990 | (WO) . |
| 94/24999 | | 11/1994 | (WO) . |
| 99/40171 | | 8/1999 | (WO) . |
| 00/43488 | | 7/2000 | (WO) . |
| 00/44869 | | 8/2000 | (WO) . |

* cited by examiner

DETERGENT COMPOSITIONS

This invention relates to cleaning compositions in the form of tablets for use in fabric washing.

Detergent powders which are formulated to provide for simultaneously cleaning and softening fabrics are known in the art.

Detergent compositions in tablet form are described, for example, in GB 911204 (Unilever), U.S. Pat. No. 3,953,350 (Kao), JP 60-015500A (Lion), and EP-A-711827 (Unilever). Tablets have several advantages over powdered products: they do not require measuring and are thus easier to handle and dispense into the washload, and they are more compact, hence facilitating more economical storage. Tablets of a cleaning composition are generally made by compressing or compacting a quantity of the composition in particulate form.

According to a first aspect of the present invention, a tablet of compacted particulate cleaning composition for use in fabric washing contains a fabric conditioning agent which is present at a greater concentration in one zone of the tablet than in another zone. The fabric conditioning agent may function to soften or lubricate the fabric and thereby inhibit wrinkling, or may otherwise affect the feel of the fabric after washing.

In certain forms of this invention, the fabric conditioning agent will serve to soften the fabric, and the tablet will be such that the zone containing the fabric softening agent at greater concentration will disintegrate and dissolve (in so far as it is water soluble) later than the said other zone. Consequently, the fabric softening agent will be released into the wash liquor later than some other ingredients of the composition.

As a consequence, the release of at least some of the fabric softening agent into the wash liquor and the deposition of it onto the fabrics in the wash will be delayed until after the washing of fabrics has started and progressed to some extent. This can reduce any interference between the functions of dirt removal from fabric and deposition of softening agent onto the fabric.

Other fabric conditioning agents—such as fabric lubricants—may be such that it is desirable to deliver them at an early stage in the wash. For these, the tablet may be such that the zone containing the fabric conditioning agent at greater concentrations will disintegrate and dissolve (insofar as it is water soluble) later than the said other zone.

Delayed disintegration of one zone of a tablet relative to the other can be implemented in several ways. These may rely on blocking access of water to the zone which is intended to disintegrate later, or may rely on forming the zone from a composition which disintegrates more slowly, or some combination of the two.

One possibility is that a first zone of the tablet is adjacent to the tablet exterior, while a second zone is wholly enclosed within the tablet or is an interior layer of the tablet which is sandwiched between outer layers and provides only a minority proportion of the exterior of the tablet.

A fabric softening agent could then be concentrated in the second zone (and hence concentrated away from the first zone).

Another possibility is that a tablet has a second zone which is a discrete region of the tablet and which disintegrates more slowly than the first zone when the tablet is placed in wash water. Such a second zone which disintegrates more slowly may provide half or somewhat more than half of the tablet exterior, but need not do so.

Such delayed disintegration of the second zone relative to the release of the surfactants contained within the first zone of the tablet may be achieved even when the second zone of the tablet provides a substantial proportion of the exterior of the tablet, by using compositions which have different rates of disintegration in water. For example disintegration enhancing materials may be included within the first zone of the tablet but not the second. Such an arrangement could simply be provided as a two layer tablet, so that each layer provides approximately half the tablet exterior, with the fabric conditioning agent concentrated in one layer.

Thus, different zones of a tablet will probably be a plurality of discrete regions, for example layers, inserts or coatings, each derived by compaction from a particulate composition, such that at least one discrete region disintegrates later than at least one other discrete region of the tablet when the tablet is placed in water, and the said fabric softening agent is present at a greater concentration in the region which disintegrates later than in the region which disintegrates earlier.

In such a "heterogeneous" tablet consisting of a plurality of discrete regions, each discrete region of the tablet will preferably have a mass of at least 1 gram preferably at least 5 gram.

The present invention also provides a process for the production of heterogenous tablets according to the first aspect of the invention. In this second aspect the invention provides a process for making a tablet of compacted particulate detergent composition for use in fabric washing which contains a fabric conditioning agent which is present at a greater concentration in one zone of the tablet than in another zone thereof, which process comprises incorporating the fabric conditioning agent into one of a plurality of detergent compositions at a greater concentration than in a second of said detergent compositions, and thereafter compacting said compositions to make respective discrete regions of the tablet. Suitably, after one composition has been compacted to form a layer of the tablet, a different detergent composition is then compacted against at least one surface of this discrete layer, to form one or more further layers of the tablet adjacent to the tablet exterior. However, other procedures are possible. For instance, GB-A-2324495 teaches the production of two layer tablets without compaction of the first layer. Various documents have contemplated the possibility of discrete regions which are not in the form of layers of a tablet.

If a fabric softening agent is to be concentrated in an interior layer of the tablet, then another detergent composition may be compacted against at least two opposite sides of the layer containing the fabric softening agent.

The tablets of the present invention may contain one or more fabric conditioning agents. The total amount of fabric conditioning agents in the tablets of the invention will, in general, be from 0.1 to 50% by weight, preferably from 0.2 or 0.5 to 10% by weight of the tablet.

A discussion of materials which are known as fabric softening agents and which may be used in the tablets of the present invention is found in published International Patent Application WO 94/24999.

Many suitable and commercially important fabric softening agents are organic compounds containing quaternary nitrogen and at least one carbon chain of 6 to 30 carbon atoms, eg. in an alkyl, alkenyl or aryl substituted alkyl or alkenyl group with at least six aliphatic carbon atoms.

Other suitable fabric softening agents are the analogous tertiary amines and imidazolines, other aliphatic alcohols, esters, amines or carboxylic acids incorporating a C8 to C30 alkyl, alkenyl or acyl group, including esters of sorbitan and esters of polyhydric alcohols, and mineral oils. Certain clays are important as fabric softening agents. Another class of materials used as fabric softening agents are hydrophobically modified cellulose ethers.

Some specific instances of fabric softening agents which may be used in the tablets of the present invention are:

1) Acyclic Quaternary Ammonium Compounds of the Formula (I)

(I)

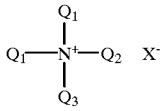

wherein each $Q_1$ is a hydrocarbyl group containing from 15 to 22 carbon atoms, $Q_2$ is a saturated alkyl or hydroxy alkyl group containing from 1 to 4 carbon atoms, $Q_3$ may be as defined for $Q_1$ or $Q_2$ or may be phenyl and $X^-$ is an anion preferably selected from halide, methyl sulphate and ethyl sulphate radicals.

Throughout this discussion of fabric softening agents, the expression hydrocarbyl group refers to alkyl or alkenyl groups optionally substituted or interrupted by functional groups such as —OH, —O—, CONH, —COO—, etc.

Representative examples of these quaternary softeners include ditallow dimethyl ammonium chloride; di(hydrogenated tallow) dimethyl ammonium chloride; di(coconut) dimethyl ammonium chloride; di(coconut) dimethyl ammonium methosulphate.

2) Ester Quaternary Ammonium Salts

A number of ester group containing quaternary ammonium salts, including those disclosed in EP 345842 A2 (Procter), EP 239910 (Procter) and U.S. Pat. No. 4,137,180 (Lever) are suitable for use in the tablets of the present invention. These materials can be represented by generic formulae (II) and (III) below.

(II)

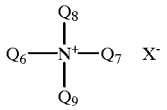

(III)

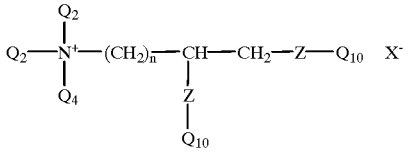

In formulae (II) and (III) each $Q_2$ is a saturated alkyl or hydroxy alkyl group containing from 1 to 4 carbon atoms;

$Q_4$ is as defined for $Q_2$ or may be phenyl;

$Q_6$ is a hydrocarbyl group (preferably alkyl) containing 1 to 4 carbon atoms;

$Q_{10}$ is a hydrocarbyl group containing from 12 to 22 carbon atoms;

$Q_7$ is $—CH_2—Y—Z—Q_{10}$ $Q_8$ is as defined for $Q_7$ or $Q_{10}$;

$Q_9$ is as defined for $Q_7$ or $Q_{10}$ or is an alkyl or hydroxyalkyl group of 1 to 4 carbon atoms or is phenyl;

Y is $—CH(OH)—CH_2—$ or is divalent alkylene of one to three carbon atoms;

Z is —O—C(O)—O, —C(O)—O or —O—C(O)— and $X^-$ is an anion.

Examples of suitable materials based on formula (II) are N,N-di(tallowyl-oxyethyl), N-methyl, N-hydroxyethyl ammonium chloride; N,N-ditallowyl-oxyethyl)-N,N-dimethyl ammonium chloride; N,N-di(2-tallowyloxy-2-oxo-ethyl)-N,N-dimethyl ammonium chloride; N,N-di(2-tallowyloxyethylcarbonyl oxyethyl)-N,N-dimethyl ammonium chloride; N-(2-tallowloxy-2-ethyl)-N-(2-tallowyl oxo-2-oxyethyl)-N,N-dimethyl ammonium chloride; N,N,N-tri(tallowyl-oxyethyl)-N-methyl ammonium chloride; N-(2-tallowyloxy-2-oxyethyl)-N-(tallowyl-N,N-dimethyl)-ammonium chloride. Tallowyl may be replaced with cocoyl, palmoyl, lauryl, oleyl, stearyl and palmityl groups. An illustrative example of a formula (III) material is 1,2-ditallowyloxy-3-trimethyl ammoniopropane chloride.

3) Quaternary Imidazolinium Salts

A further class of cationic softener materials is the imidazolinium salts of generic formula (IV).

(IV)

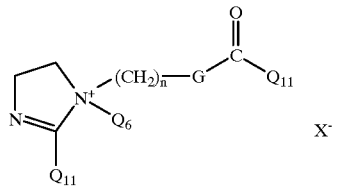

wherein $Q_{11}$ is a hydrocarbyl group containing from 6 to 24 carbon atoms, G is —N(H)—, or —O—, or $—NQ_2—$, n is an integer between 1 and 4, and $Q_2$ and $Q_6$ are as defined above.

Preferred imidazolinium salts include 1-methyl-1-(tallowylamido) ethyl-2-tallowyl-4,5 dihydro imidazolinium methosulphate and 1-methyl-1-(palmitoylamido) ethyl-2-octadecyl-4,5-dihydroimidazolinium chloride. Other useful imidazolinium materials are 2-heptadecyl-1-methyl-1-(2 stearylamido) ethyl imidazolinium chloride and 2-lauryl-1-hydroxyethyl-1-oleyl imidazolinium chloride. Also suitable are the imidazolinium fabric softening components of U.S. Pat. No. 4,127,489.

4) Primary, Secondary and Tertiary Amines

Primary secondary and tertiary amines of general formula (V) are useful as softening agents.

(V)

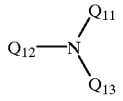

wherein $Q_{11}$ is hydrocarbyl group containing from 6 to 24 carbon atoms, $Q_{12}$ is hydrogen or a hydrocarbyl group containing from 1 to 22 carbon atoms and $Q_{13}$ can be hydrogen or a hydrocarbyl group containing from 1 to 6 carbon atoms. Preferably amines are protonated with hydrochloric acid, orthophosphoric acid or citric acid or any other similar acids for use in cleaning compositions of the present invention. Specific examples of tertiary amines that are suitable for use in the tablets of the present invention are those disclosed in EP 213720 (Unilever).

5) Cellulase

British Patent Specification GB 1 368 599 (Unilever) discloses the use of cellulolytic enzymes, ie. cellulases, as harshness reducing agents. It is thought that cellulase achieves its anti-harshening effect on, eg. cotton, by cleaving the cellulosic fibrils which form on the cotton fibres during the normal washing process. This cleavage prevents the fibrils from bonding together and thereby introducing a degree of rigidity into the fabric.

It is preferred to use cellulases which have an optimum activity at alkaline pH values, such as those described in British Patent Specifications GB 2 075 028 A (Novo Industrie A/S), GB 2 095 275 A (Kao Soap Co Ltd) and GB 2 094 826 A (Kao Soap Co Ltd).

Examples of such alkaline cellulases are cellulases produced by a strain of *Humicola insolens* (*Humicola grisea* var. *thermoidea*), particularly the Humicola strain DSM 1800, cellulases produced by a fungus of Bacillus N or a cellulase 212-producing fungus belonging to the genus Aeromonas, and cellulase extracted from the hepatopancreas of a marine mollusc (*Dolabella Auricula Solander*).

The amount of cellulase in a tablet of the invention will, in general, be from 0.1 to 10% by weight. In terms of cellulase activity the use of cellulase in an amount corresponding to from 0.25 to 150 or higher regular $C_x$ units/gram of the detergent composition is within the preferred scope of the present invention. A most preferred range of cellulase activity, however, is from 0.5 to 25 regular $C_x$ units/gram of the detergent composition.

6) Clays

Certain clays with ion exchange properties are effective as fabric softeners. It is believed that clay materials achieve their softening benefit on, eg. cotton, by coating the cotton fibrils with a layer of lubricating material. This coating lowers the friction between the fibrils and reduces their tendency to bond together.

Suitable clay materials are phyllosilicate clays with a 2:1 layer structure, which definition includes smectite clays such as pyrophyllite, montmorillonite, hectorite, saponite and vermiculite, and includes micas. Particularly suitable clay materials are the smectite clays described in U.S. Pat. No. 4,062,647 (Storm et al assigned to The Procter & Gamble Company). Other disclosures of suitable clay materials for fabric softening purposes include European patent specification EP 26528-A (Procter & Gamble Limited). U.S. Pat. No. 3,959,155 (Montgomery et al assigned to The Procter & Gamble Company), and U.S. Pat. No. 3,936,537 (Baskerville).

EP 177 165 (Unilever) discloses that clays can be used in combination with cellulase. Also suitable for use in the tablets of the present invention are the combinations of clays and tertiary amines which are disclosed in EP 011340 (The Procter & Gamble Company).

Particularly preferred clays have an ion exchange capacity of at least 50 meq/100 g of clay. The ion exchange capacity relates to the expandable properties of the clay and to the charge of the clay, and is conventionally measured by electrodialysis or by exchange with ammonium ion followed by titration.

The level of fabric softening clay material in the tablets of the invention should be sufficient to provide the fabrics with a softening benefit. A preferred level is from 1 to 50% by weight of the tablet, better from 5% to 35% by weight of the tablet, most preferably from 4% to 15%, these percentages referring to the level of the clay mineral per se. Levels of clay raw material higher than this may be necessary when the raw material is derived from a particularly impure source.

Silicone oils (polysiloxanes) have been proposed as fabric conditioning agents, and more specifically polysiloxanes with amino alkyl side chains have been proposed. Discussions of these materials can be found in GB-A-1549180 where they are included in fabric softener formulations to assist ironing of the fabric and to inhibit wrinkling.

EP-A-150867 (Procter & Gamble) discloses the incorporation of amino alkyl polysiloxanes into particulate detergent compositions to enhance the softeners and handling of washed fabrics. Their use in particulate compositions is also disclosed in FR-A-2713237 (Rhone-Poulenc) which utilises them as fabric softeners. These materials may be mixed into nonionic detergent before that is incorporated into a particulate composition, as taught by EP-A-150867, or absorbed directly onto a particulate carrier, as taught by FR-A-271237, and mixed with the remainder of a particulate composition. The particulate composition can thereafter be compacted to form a zone of a tablet in accordance with the present invention.

The amino alkyl polysiloxanes function as fibre lubricants. They are desirably incorporated into the more rapidly disintegrating first zone(s) of a tablet of this invention, so as to deposit on fabric at an early stage of the washing cycle.

Another fabric conditioning agent which could be incorporated in a zone of tablets according to this invention is a curable amine functional silicone (amino alkyl polysiloxane) disclosed in U.S. Pat. No. 4,911,852 (Procter & Gamble) as an anti-wrinkle agent.

A preferred tablet of the present invention contains from 2 or 5 wt % up to 40 or 50 wt % surfactant, 5 or 10 up to 60 or 80 wt % detergency builder and from 0.1 to 50 wt % of one or more fabric conditioning agents. These percentage ranges for surfactant and builder may apply to the overall composition of the tablet, and also to at least one discrete region of the tablet.

Surfactant Compounds

Compositions which are compacted to form discrete zones in tablets of this invention contain one or more detergent surfactants. In a fabric washing composition, these preferably provide from 5 to 50% by weight of the overall tablet composition up to 40% or 50% by weight. Surfactant may be anionic (soap or non-soap), zwitterionic, amphoteric, nonionic or a combination of these. Many suitable detergent surfactants are commercially available and are fully described in the literature, for example in "Surface Active Agents and Detergents", Volumes I and II, by Schwartz, Perry and Berch.

Anionic surfactant may be present in an amount from 0.5 to 50% by weight, preferably from 2% or 4% up to 30% or 40% by weight of the tablet composition.

Synthetic (i.e. non-soap) anionic surfactants are well known to those skilled in the art. Examples include alkylbenzene sulphonates, particularly sodium linear alkylbenzene sulphonates having an alkyl chain length of $C_8$–$C_{15}$; olefin sulphonates; alkane sulphonates; dialkyl sulphosuccinates; and fatty acid ester sulphonates.

Primary alkyl sulphate having the formula $$ROSO_3^-M^+$$

in which R is an alkyl or alkenyl chain of 8 to 18 carbon atoms especially 10 to 14 carbon atoms and $M^+$ is a solubilising cation, is commercially significant as an anionic surfactant. Linear alkyl benzene sulphonate of the formula

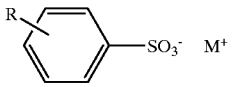

where R is linear alkyl of 8 to 15 carbon atoms and $M^+$ is a solubilising cation, especially sodium, is also a commercially significant anionic surfactant.

Frequently, such linear alkyl benzene sulphonate or primary alkyl sulphate of the formula above, or a mixture thereof, will be the desired anionic surfactant and may provide 75 to 100 wt % of any anionic non-soap surfactant in the composition.

In some forms of this invention the amount of non-soap anionic surfactant lies in a range from 5 to 20 wt % of the tablet composition.

It may also be desirable to include one or more soaps of fatty acids. These are preferably sodium soaps derived from naturally occurring fatty acids, for example, the fatty acids from coconut oil, beef tallow, sunflower or hardened rapeseed oil.

Suitable nonionic surfactant compounds which may be used include in particular the reaction products of compounds having a hydrophobic group and a reactive hydrogen atom, for example, aliphatic alcohols, acids, amides or alkyl phenols, with alkylene oxides, especially ethylene oxide.

Specific nonionic surfactant compounds are alkyl ($C_{8-22}$) phenol-ethylene oxide condensates, the condensation products of linear or branched aliphatic $C_{8-20}$ primary or secondary alcohols with ethylene oxide, and products made by condensation of ethylene oxide with the reaction products of propylene oxide and ethylene-diamine.

Especially preferred are the primary and secondary alcohol ethoxylates, especially the $C_{9-11}$ and $C_{12-15}$ primary and secondary alcohols ethoxylated with an average of from 5 to 20 moles of ethylene oxide per mole of alcohol.

In certain forms of this invention the amount of nonionic surfactant lies in a range from 4 to 40%, better 4 or 5 to 30 % by weight of the composition.

Many nonionic surfactants are liquids. These may be absorbed onto particles of the composition.

Amounts of amphoteric or zwitterionic detergent compounds may also be used in the compositions of the present invention, but this is not normally desired due to their relatively high cost. If any amphoteric or zwitterionic detergent compounds are used it is generally in small amounts in compositions which are based on the much more commonly used synthetic anionic and/or nonionic detergent compounds.

Detergency Builder

A composition which is compacted to form tablet regions will generally contain from 15 to 80%, more usually 15 to 60% by weight of detergency builder. This may be provided wholly by water-soluble materials, or may be provided in large part or even entirely by water-insoluble materials with water-softening properties. Water-insoluble detergency builder may be present as 5 to 80 wt %, better 5 to 60 wt % of the composition.

Alkali metal aluminosilicates are strongly favoured as environmentally acceptable water-insoluble builders for fabric washing. Alkali metal (preferably sodium) aluminosilicates may be either crystalline or amorphous or mixtures thereof, having the general formula:

$$0.8\text{–}1.5\ Na_2O.Al_2O_3.0.8\text{–}6\ SiO_2.xH_2O$$

These materials contain some bound water (indicated as "xH2O") and are required to have a calcium ion exchange capacity of at least 50 mg CaO/g. The preferred sodium aluminosilicates contain 1.5–3.5 $SiO_2$ units (in the formula above). Both the amorphous and the crystalline materials can be prepared readily by reaction between sodium silicate and sodium aluminate, as amply described in the literature.

Suitable crystalline sodium aluminosilicate ion-exchange detergency builders are described, for example, in GB 1429143 (Procter & Gamble). The preferred sodium aluminosilicates of this type are the well known commercially available zeolites A and X, the novel zeolite P described and claimed in EP 384070 (Unilever) and mixtures thereof.

Conceivably a water-insoluble detergency builder could be a layered sodium silicate as described in U.S. Pat. No. 4,664,839. NaSKS-6 is the trademark for a crystalline layered silicate marketed by Hoechst (commonly abbreviated as "SKS-6"). NaSKS-6 has the delta-$Na_2SiO_5$ morphology form of layered silicate. It can be prepared by methods such as described in DE-A-3,417,649 and DE-A-3,742,043. Other such layered silicates, such as those having the general formula $NaMSi_xO_{2x+1}.yH_2O$ wherein M is sodium or hydrogen, x is a number from 1.9 to 4, preferably 2, and y is a number from 0 to 20, preferably 0 can be used.

Water-soluble phosphorous-containing inorganic detergency builders, include the alkali-metal orthophosphates, metaphosphates, pyrophosphates and polyphosphates. Specific examples of inorganic phosphate builders include sodium and potassium tripolyphosphates, orthophosphates and hexametaphosphates.

Non-phosphorous water-soluble builders may be organic or inorganic. Inorganic builders that may be present include alkali metal (generally sodium) carbonate; while organic builders include polycarboxylate polymers, such as polyacrylates, acrylic/maleic copolymers, and acrylic phosphonates, monomeric polycarboxylates such as citrates, gluconates, oxydisuccinates, glycerol mono- di- and trisuccinates, carboxymethyloxysuccinates, carboxymethyloxymalonates, dipicolinates and hydroxyethyliminodiacetates.

Tablet compositions preferably include polycarboxylate polymers, more especially polyacrylates and acrylic/maleic copolymers which can function as builders and also inhibit unwanted deposition onto fabric from the wash liquor.

Bleach System

Tableted detergent and fabric softening compositions according to the invention may contain a bleach system. This preferably comprises one or more peroxy bleach compounds, for example, inorganic persalts or organic peroxyacids, which may be employed in conjunction with activators to improve bleaching action at low wash temperatures. If any peroxygen compound is present, the amount is likely to lie in a range from 10 to 25% by weight of the composition.

Preferred inorganic persalts are sodium perborate monohydrate and tetrahydrate, and sodium percarbonate, advantageously employed together with an activator. Bleach activators, also referred to as bleach precursors, have been widely disclosed in the art. Preferred examples include peracetic acid precursors, for example, tetraacetylethylene diamine (TAED), which is now in widespread commercial use in conjunction with sodium perborate, and perbenzoic acid precursors. The quaternary ammonium and phosphonium bleach activators disclosed in U.S. Pat. Nos. 4,751,015 and 4,818,426 (Lever Brothers Company) are also of interest. Another type of bleach activator which may be used, but which is not a bleach precursor, is a transition metal catalyst as disclosed in EP-A-458397, EP-A-458398 and EP-A-549272.

As indicated above, if a bleach is present and is a water-soluble inorganic peroxygen bleach, the amount may well be from 10% to 25% by weight of the composition. Moreover, a peroxygen bleach and/or a bleach activator may be present at a greater concentration in one zone of the tablet than in another.

Other Detergent Ingredients

The detergent tablets of the invention may also contain one of the detergency enzymes well known in the art for their ability to degrade and aid in the removal of various soils and stains. Suitable enzymes include the various proteases, cellulases, lipases, amylases, and mixtures thereof, which are designed to remove a variety of soils and stains from fabrics. Examples of suitable proteases are Maxatase (Trade Mark), as supplied by Gist-Brocades N. V., Delft, Holland, and Alcalase (Trade Mark), and Savinase (Trade Mark), as supplied by Novo Industri A/S, Copenhagen, Denmark. Detergency enzymes are commonly employed in the form of granules or marumes, optionally with a protective coating, in amount of from about 0.1% to about 3.0% by weight of the composition; these granules or marumes present no problems with respect to compaction to form a tablet.

The detergent tablets of the invention may also contain a fluorescer (optical brightener), for example, Tinopal (Trade Mark) DMS or Tinopal CBS available from Ciba-Geigy AG, Basel, Switzerland. Tinopal DMS is disodium 4,4'bis-(2-morpholino-4-anilino-s-triazin-6-ylamino)stilbene disulphonate; and Tinopal CBS is disodium 2,2'-bis-(phenylstyryl)disulphonate.

An antifoam material is advantageously included, especially if a detergent tablet is primarily intended for use in front-loading drum-type automatic washing machines. Suitable antifoam materials are usually in granular form, such as those described in EP 266863A (Unilever). Such antifoam granules typically comprise a mixture of silicone oil, petroleum jelly, hydrophobic silica and alkyl phosphate as antifoam active material, absorbed onto a porous water-soluble carbonate-based inorganic carrier material. Antifoam granules may be present in an amount up to about 5% by weight of the composition.

It may also be desirable that a detergent tablet of the present invention includes an amount of an alkali metal silicate, particularly sodium ortho-, meta- or disilicate. The presence of such alkali metal silicates at levels, for example, of 0.1 to 10 wt %, may be advantageous in providing protection against the corrosion of metal parts in washing machines, besides providing some measure of building and giving processing benefits in manufacture of the particulate material which is compacted into tablets.

A composition for fabric washing will generally not contain more than 15 wt % silicate. A composition for machine dishwashing will often contain more than 20 wt % silicate.

The detergent tablets of the invention may also contain a perfume composition. The perfume composition will normally consist of a plurality of perfumery materials having fragrance, and may include a minor proportion (less than 50% by weight of the perfume) of odourless organic solvent which serves as a carrier. Perfume compositions suitable for use in fabric washing have been disclosed in various documents including EP 332259 (Procter) and are available from perfume houses such as Quest International, Naarden, Netherlands. A perfume composition may have deodorant properties, as disclosed in U.S. Pat. Nos. 4,304,679, 4,663,068, 5,501,805 and 5,554,588.

The total amount of perfume in a tablet is likely to be from 0.1 to 5% by weight of the tablet, preferably from 0.1 to 2%. In many fabric washing products, the amount of perfume is less than 1%. The total amount of perfume in a tablet may therefore be in a range from 0.1 to 0.5%.

Further ingredients which can optionally be employed in fabric washing and softening tablets of the present invention include anti-redeposition agents such as sodium carboxymethylcellulose, straight-chain polyvinyl pyrrolidone and cellulose ethers such as methyl cellulose and ethyl hydroxyethyl cellulose, heavy metal sequestrants such as EDTA, and colorants or coloured speckles. Thus the zones of the tablet may be of different colour.

Particle Size and Distribution

A discrete region of a detergent and fabric softening tablet of the present invention is a matrix of compacted particles.

Preferably the particulate composition has an average particle size in the range from 200 to 2000 $\mu$m, more preferably from 250 to 1400 $\mu$m. Fine particles, smaller than 180 $\mu$m or 200 $\mu$m may be eliminated by sieving before tableting, if desired, although we have observed that this is not always essential.

Tableting

Tableting entails compaction of a particulate composition. A variety of tableting machinery is known, and can be used. Generally it will function by stamping a quantity of the particulate composition which is confined in a die.

Manufacture of a tablet with two layers of differing composition may be carried out by placing a predetermined quantity of one composition in a mould, then adding a second composition on top, and next driving a die into the mould to cause compaction.

Alternatively, a predetermined quantity of a first composition may be placed in a mould and compacted by driving a die into the mould, followed by removing the die, adding a second composition and compacting again.

Tableting machinery able to carry out such operations is known. For example, suitable tablet presses are available from Fette and from Korch.

The size of a tablet will suitably range from 10 to 160 grams, preferably from 15 to 60 g, depending on the conditions of intended use, and whether the tablet represents a dose for an average load in a fabric washing or a fractional part of such a dose. The tablets may be of any shape. However, for ease of packaging they are preferably blocks of substantially uniform cross-section, such as cylinders or cuboids. The overall density of a tablet preferably lies in a range from 1040 or 1050 gm/liter up to 1300 gm/liter and possibly higher such as up to 1400 gm/liter or more. The tablet density may well lie in a range up to no more than 1250 or even 1200 gm/liter. Even if density is high, a tablet for use in fabric washing will generally have some porosity.

Preferred embodiments of the invention will now be described by way of example only with reference to the accompanying drawings, in which.

EXAMPLE 1

Figure 1:
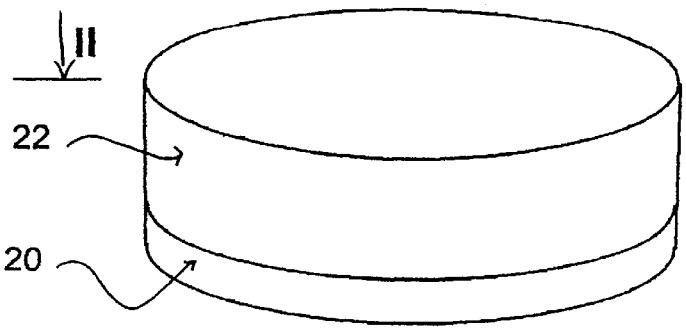
FIG. 1 is a perspective view of a heterogenous tablet of the present invention.
Figure 2:
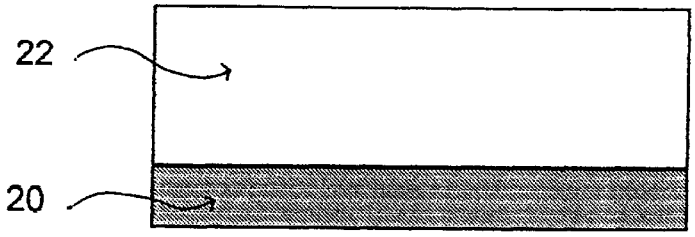
FIG. 2 is a cross section through the tablet of FIG. 1 on the line II—II.

Tablets are prepared, having two layers of different is compositions as set out in the following table. 30 gram portions of composition A are used to make the thicker layer 22 of a two layer tablet as illustrated by FIGS. 1 and 2. The thinner layer 20 of these tablets is made using 10 gram portions of composition B.

| | % by weight | |
|---|---|---|
| | A | B |
| Granulated Components | | |
| coconut primary alkyl sulphate | 10.9 | 10.0 |
| coconut alcohol 3EO | 7.0 | 6.4 |
| coconut alcohol 6EO | 6.1 | 5.6 |
| zeolite A24 | 37.0 | 18.7 |
| soap | 4.0 | 3.7 |
| SCMC | 1.2 | 1.1 |
| fluorescer | 0.3 | 0.2 |
| water | 7.5 | 6.9 |
| Postdosed Components | | |
| PEG 1500 | 4.3 | 4.3 |
| sodium perborate tetrahydrate | 0.0 | 19.5 |
| TAED granule | 0.0 | 4.2 |
| protease | 1.5 | 0.0 |
| amylase | 0.8 | 0.0 |
| lipase | 0.8 | 0.0 |
| bentonite clay having a cation exchange capacity of 95 meq/100 g | 0.0 | 16.0 |
| antifoam | 3.4 | 3.4 |
| sodium citrate dihydrate | 15.2 | 0.0 |

Composition A contains enzymes and also sodium citrate dihydrate which promotes disintegration when the composition is added to water (as disclosed in EP-A-711827); composition B contains a fabric softening clay and bleach, but does not contain sodium citrate dihydrate.

For each composition, the materials listed as "granulated components" are mixed in a Fukae (Trade Mark) FS-100 high speed mixer-granulator. The soap is prepared in situ by neutralisation of fatty acid. The mixture is granulated and densified to give a powder of bulk density greater than 750 g/liter and a mean particle size of approximately 650 $\mu$m. The powder is sieved to remove fine particles smaller than 180 $\mu$m and large particles exceeding 1700 $\mu$m. The remaining solids are then mixed with the powder in a rotary mixer, after which the PEG is sprayed on at about 80° C. with the powder at 35 to 40° C.

One layer of the tablet, indicated as 22 in FIG. 1, is prepared by compacting a 30 gram portion of the powder of detergent composition A using a compaction pressure of 35 $N.cm^{-2}$, thus producing a first cylindrical layer of the detergent and fabric softening tablet as illustrated by FIG. 1. After this first layer 22 has been prepared, the thinner second layer 20 is formed from 10 grams of powder of composition B compacted against one surface of the first layer 22.

When the tablets are added to water the first layer of composition A disintegrates first, because of the presence of sodium citrate dihydrate. Consequently, the enzymes are released into the wash liquor ahead of the bleach and fabric softening clay.

Figure 3:
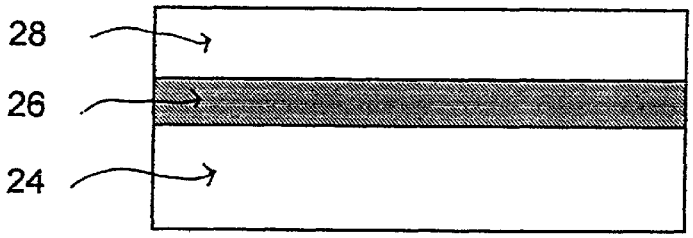
FIG. 3 is a cross section through another embodiment of a heterogeneous tablet of the present invention.

FIG. 3 shows a variation in which 18 gm of powder A is used to make a layer 24, 10 gm of powder B is compacted against one surface of layer 24, to form an internal layer 26 and then 12 gm of powder A is compacted against layer 26 to form a layer 28. Thus the second zone of the tablet is then the internal layer 26 sandwiched between layers 24 and 28 which happen to be unequal in size.

EXAMPLE 2

Tablets are prepared, having two layers of similar size but different compositions, as set out in the following table:

| | % by weight | |
|---|---|---|
| | C | D |
| Granulated Components | | |
| coconut primary alkyl sulphate | 10.9 | 10.0 |
| coconut alcohol 3EO | 7.0 | 6.4 |
| coconut alcohol 6EO | 6.1 | 5.6 |
| zeolite A24 | 37.0 | 31.0 |
| soap | 4.0 | 3.7 |
| SCMC | 1.2 | 1.1 |
| fluorescer | 0.3 | 0.2 |
| water | 7.5 | 6.9 |
| Postdosed Components | | |
| PEG 1500 | 4.3 | 4.3 |
| sodium perborate tetrahydrate | 0.0 | 19.11 |
| TAED granule | 0.0 | 4.2 |
| protease | 1.5 | 0.0 |
| amylase | 0.8 | 0.0 |
| lipase | 0.8 | 0.0 |
| tallowyl dimethyl amine | 0.0 | 4.0 |
| antifoam | 3.4 | 3.4 |
| sodium citrate dihydrate | 15.2 | 0.0 |

As can be seen from the table, the compositions have different post-dosed components: composition C contains enzymes and also sodium citrate dihydrate which promotes disintegration when the composition is added to water, whereas composition D contains tertiary amine as a fabric softener and also bleach, but does not contain citrate dihydrate.

The two compositions are used to make tablets with two layers, analogous to the two layer tablets of Example 1 (FIGS. 1 and 2) except that equal quantities of the compositions are used.

When the tablets are added to water, the layer of composition C disintegrates first, because of the presence of sodium citrate dihydrate. Consequently the enzymes are released into the wash liquor ahead of the bleach and the fabric softener.

EXAMPLE 3

Figure 4:
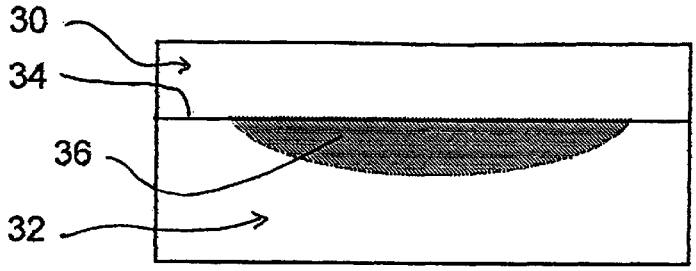
FIGS. 4 and 5 are cross sections through yet further embodiments of tablet of the present invention.

FIG. 4 shows another arrangement. In this tablet a relatively thick bottom layer 32 and a thinner top layer 30 are prepared from the same detergent powder, which is the same as composition D used in Example 2, except that it contains 35% zeolite and no tertiary amine.

One layer of the tablet, indicated as 32 in FIG. 4, is prepared by compacting 25 gram portions of the detergent powder.

After this bottom layer has been prepared by compacting a portion of the detergent composition, a quantity of tallowyl dimethyl amine as used in Example 2 is dosed directly onto the middle of its surface 34. This liquid fabric softening agent is absorbed and spreads out but remains within a zone 36 shown shaded in FIG. 4. Subsequently the thinner top layer 30 is formed from another 15 grams of the same detergent powder compacted over the surface 34 which becomes the interface between the two layers 30, 32. The zone 36 is now within the interior of the two layer tablet as shown by FIG. 4. When the tablets are used, they disintegrate progressively and the fabric softening agent is not released until the outer parts of the tablet have broken away from the interior zone 36.

EXAMPLE 4

Figure 5:
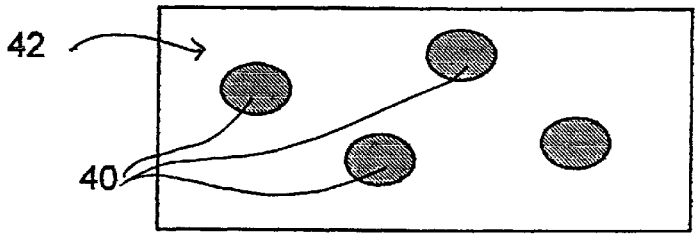

FIG. 5 shows a further possibility. Composition B of Example 1 is compacted into pellets 40 which are then mixed with the powder of composition A, in a weight ratio of 3 parts A to 1 part pellets. The resulting mixture is then compacted into tablets in which the pellets 40 constitute a plurality of second zones isolated within a continuous first zone 42.

EXAMPLE 5

Tablets are prepared, having two layers of similar size but different compositions, as set out in the following table:

| | % by weight | |
|---|---|---|
| | E | F |
| Granulated Components | | |
| coconut primary alkyl sulphate | 10.9 | 10.0 |
| coconut alcohol 3EO | 7.0 | 6.4 |
| coconut alcohol 6EO | 6.1 | 5.6 |
| zeolite A24 | 33.0 | 35.0 |
| soap | 4.0 | 3.7 |
| SCMC | 1.2 | 1.1 |
| amino alkyl polysiloxane | 4.0 | 0.0 |
| fluorescer | 0.3 | 0.2 |
| water | 7.5 | 6.9 |
| Postdosed Components | | |
| PEG 1500 | 4.3 | 4.3 |
| sodium perborate tetrahydrate | 0.0 | 19.5 |
| TAED granule | 0.0 | 4.2 |
| protease | 1.5 | 0.0 |
| amylase | 0.8 | 0.0 |
| lipase | 0.8 | 0.0 |
| antifoam | 3.4 | 3.4 |
| sodium citrate dihydrate | 15.2 | 0.0 |

As can be seen from the table, the compositions are similar to those of Example 2 but composition E contains amino alkyl polysiloxane as well as enzymes and sodium citrate dihydrate which promotes disintegration when the composition is added to water. Composition F contains bleach but does not contain citrate dihydrate. The amino alkyl polysiloxane is Rhodocil (Trade Mark) from Rhone-Poulenc as exemplified in FR-A-2713237.

The two compositions are used to make tablets similar to the two layer tablets of Example 1 (FIGS. 1 and 2) except that equal quantities of the compositions are used.

When the tablets are added to water the layer of composition E disintegrates first, because of the presence of sodium citrate dihydrate.

What is claimed is:

1. A tablet of compacted particulate detergent composition for use in fabric washing, which tablet contains discrete regions such that at least one discrete region disintegrates later than at least one other discrete region when the tablet is placed in water, the tablet comprising:

(i) a fabric softening agent in a greater concentration in the region which disintegrates later than in the region which disintegrates earlier;

(ii) a disintegration promoting agent (iii) 2–50% by weight surfactant;

(iv) 5–80% by weight detergency builder wherein the builder comprises water insoluble detergency builder in an amount of from 5–60% by weight of the tablet;

wherein both the later-disintegrating and the earlier-disintegrating regions are exposed as part of tablet exterior.

2. A tablet according to claim 1 wherein said regions are layers of the tablet.

3. A tablet according to claim 1 which contains 0.1 to 50% by weight of one or more fabric softening agents.

4. A tablet according to claim 1 which contains 0.2 to 10% by weight of one or more fabric softening agents.

5. A tablet according to claim 4 wherein said fabric softening agent is selected from the group consisting of (i) fabric softening clays, (ii) organic compounds containing quaternary nitrogen and at least one carbon chain of 6 to 30 carbon atoms, (iii) organic tertiary amines and imidazolines incorporating at least one carbon chain of 6 to 30 carbon atoms, and (iv) polysiloxanes.

6. A tablet according to claim 4 wherein said fabric softening agent is cellulase.

7. A tablet according to claim 6 which contains 0.1 to 10% by weight of said cellulase.

8. A tablet according to claim 6 wherein the cellulase activity in the tablet is from 0.25 to 150 regular $C_x$ units per gram of the tablet composition.

9. A tablet according to claim 1 further comprising a peroxygen bleach and/or a bleach activator which is present at a greater concentration in one zone of the tablet than in another.

10. The tablet of claim 1 wherein the tablet contains overall from 5–50% by weight of surfactant, 5–80% by weight of detergency builder and from 0.1–50% by weight of the fabric softening agent.

11. A tablet according to claim 10 wherein said fabric softening agent is selected from the group consisting of (i) fabric softening clays, (ii) organic compounds containing quaternary nitrogen and at least one carbon chain of 6 to 30 carbon atoms, (iii) organic tertiary amines and imidazolines incorporating at least one carbon chain of 6 to 30 carbon atoms, and (iv) polysiloxanes.

12. A tablet according to claim 10 wherein a said fabric softening agent is cellulase.

13. A tablet according to claim 12 which contains 0.1 to 10% by weight of said cellulase.

14. A tablet according to claim 10 further comprising a peroxygen bleach and/or a bleach activator which is present at a greater concentration in one zone of the tablet than in another.

* * * * *